US008435127B2

(12) United States Patent
Boessling

(10) Patent No.: US 8,435,127 B2
(45) Date of Patent: May 7, 2013

(54) RECREATIONAL AMUSEMENT

(76) Inventor: Leon L. Boessling, New Braunfels, TX (US)

( * ) Notice: Subject to any disclaimer, the term of this patent is extended or adjusted under 35 U.S.C. 154(b) by 0 days.

(21) Appl. No.: 12/932,257

(22) Filed: Feb. 22, 2011

(65) Prior Publication Data

US 2011/0207542 A1 Aug. 25, 2011

Related U.S. Application Data

(60) Provisional application No. 61/338,746, filed on Feb. 23, 2010.

(51) Int. Cl.
*A63D 15/04* (2006.01)

(52) U.S. Cl.
USPC ..... 473/14; 473/10

(58) Field of Classification Search ..... 473/1, 10, 473/14, 15, 16, 29; 273/309
See application file for complete search history.

(56) References Cited

U.S. PATENT DOCUMENTS 1,599,188 A 9/1926 Seede
1,755,062 A * 4/1930 Hernes et al. ..... 473/10
2,312,882 A 3/1943 Cusano
2,470,238 A * 5/1949 Correale et al. ..... 473/14
2,818,256 A * 12/1957 Hopper ..... 473/14
2,990,180 A 6/1961 Koci
3,174,752 A 3/1965 Plentis
3,214,171 A * 10/1965 Luchsinger ..... 473/496
3,219,349 A 11/1965 Smith
3,232,619 A * 2/1966 Burk ..... 473/342
3,403,911 A 10/1968 Horst
3,762,711 A 10/1973 Cooper
3,865,377 A 2/1975 Cooper
3,907,294 A 9/1975 Breslow
4,017,078 A 4/1977 Goldfarb
4,063,728 A * 12/1977 Zemanek ..... 473/13
4,365,803 A * 12/1982 Barnes et al. ..... 473/14
4,513,964 A 4/1985 Gunderson
D285,943 S 9/1986 Sadleir
5,011,147 A * 4/1991 Thomas et al. ..... 273/126 A
5,183,261 A * 2/1993 Nobi ..... 473/109
D361,795 S 8/1995 Abrudan
D370,699 S 6/1996 Alford
5,752,886 A * 5/1998 Tien ..... 473/14
5,884,911 A 3/1999 Guridi
6,109,607 A * 8/2000 Cartwright et al. ..... 473/14
RE37,451 E 11/2001 Guridi
6,347,797 B1 * 2/2002 Tsai ..... 473/14
6,349,939 B1 * 2/2002 Tsai ..... 473/10
6,502,819 B2 * 1/2003 Rieber et al. ..... 473/10
D476,697 S * 7/2003 Guridi ..... D21/321
D495,372 S 8/2004 Oister
6,893,017 B1 * 5/2005 Thomas et al. ..... 473/1
D562,910 S 2/2008 Campion
2005/0049056 A1 * 3/2005 Padilla ..... 473/10
2007/0075485 A1 4/2007 Derman
2007/0075486 A1 * 4/2007 Silva ..... 273/126 R (Continued)

*Primary Examiner* — Mitra Aryanpour
(74) *Attorney, Agent, or Firm* — Wayne J. Colton, Inc.

(57) ABSTRACT

A recreational amusement includes a shuffleboard accessory utilized on and in connection with a billiard table to provide a table-type shuffleboard game. At least one rail cushion of an otherwise conventional billiard table is utilized to form a rebounding cushion for use in play of the shuffleboard game. Protective sheets or a rigid tray may be variously included for protecting materials forming the billiard table.

18 Claims, 5 Drawing Sheets

U.S. PATENT DOCUMENTS

2007/0075487 A1* 4/2007 Silva ..... 273/126 R
2007/0257428 A1* 11/2007 Silva et al. ..... 273/108
2011/0074106 A1 3/2011 Allshouse
2011/0207542 A1* 8/2011 Boessling ..... 473/29

* cited by examiner

RECREATIONAL AMUSEMENT

RELATED APPLICATION

This present application claims all available benefit, under 35 U.S.C. §119(e) to co-pending U.S. Provisional patent application Ser. No. 61/338,746 filed Feb. 23, 2010. By this reference, the full disclosure, including the drawings, of U.S. Provisional patent application Ser. No. 61/338,746 is incorporated herein as though now set forth in its entirety.

FIELD OF THE INVENTION

The present invention relates to recreation. More particularly, the invention relates to recreational amusement specifically adapted to make use of the existing structures of a billiards-type table for the provision and play of a shuffleboard game.

BACKGROUND OF THE INVENTION

Billiards-type table games date to at least as early as the court of King Louis XI of France when the King simply had a section of lawn brought indoors and placed on a large, otherwise everyday table. Soon after, as the popularity of cue sports increased, cloth-covered tables specifically manufactured for billiards-type games were developed comprising wooden beds bounded by rails lined with cloth covered cushions of straw or felt. By the nineteenth century, high quality billiards-type tables with cloth covered slate beds and vulcanized rubber cushions were available, giving early rise to the specialty billiards industry much as it exists still today with custom manufacturers producing high quality made-to-order tables alongside large manufacturers producing tables in mass.

As with any popular recreational activity, the early game of billiards has evolved into a wide variety of cue sports, including among others the games of pool and snooker, which utilize pockets arranged for collecting balls during play—resulting in pool sometimes being referred to as pocket billiards, and carom billiards, which include games played on tables without pockets. In addition to the differences with respect to pockets, it is also noted that tables manufactured for particular use with each of these various games will often differ in dimension, variations in dimension likewise being common even as between tables for one game. For example, it is commonplace that pool tables, while generally always being proportioned in a 2:1 rectangular shape, may be found in lengths of nine, seven or even five feet. As used herein, however, the term "billiard table" is expressly defined as meaning all tables for the play of billiards-type games, specifically including billiards, pool, snooker and all manner of carom billiards, a "billiard table," as such term is used herein, being characterized as a table with a top surface comprising a substantially flat bed bounded by elastic cushions affixed to the inner sides of rails provided about the perimeter of the bed.

While billiard tables may take any of a wide variety of sizes and shapes, at least two constants generally prevail. First, acquisition of a quality billiard table generally requires a significant financial investment. Second, the acquisition of a billiard table requires a significant allocation of space in order to not only house the table, but also to allow appropriate room about the table for comfortable play of the game. Furthermore, because a billiard table of any reasonable quality is generally quite heavy in weight, it is generally impractical to move the table from the edge of a room to the center just for play. Even were this not the case, however, it is noted that because the play of billiards-type games generally requires a very level playing surface, any such movement would also necessitate leveling of the table once in place, an activity sure to dampen the pleasure of use. As a result, the required allocation of space, made upon substantial financial investment, is generally to the longstanding, if not permanent, exclusion of other recreational amusements as may otherwise have been had.

One such recreational amusement, the acquisition of which is often precluded by the prior purchase and placement of a billiard table, is a shuffleboard table. Often as expensive as a quality billiard table, a typical traditional shuffleboard table measures nearly two feet wide and ranges anywhere from nine to 22 feet in length. To be sure, the size requirement for a shuffleboard table is so great that a variant of the game has recently become popular in which a puck is launched across the table's surface from a first end and rebounded from an elastic curb fitted to the opposite, second end in an attempt to return to puck to the scoring area in the first end. While this manner of modified play reduces the length of the shuffleboard table, it generally also requires a widening of the table. As a result, even the modified shuffleboard table generally requires about the same amount of space as does a billiard table and, like and for the same reasons as with a billiard table, is also preferably permanently placed.

With the foregoing limitations of the prior art clearly in mind, it is an overriding object of the present invention to improve over the prior art by providing a method and apparatus by which the required investment of financial capital and allocation of space for the acquisition of a billiard table may be further recouped by enabling the billiard table to be utilized for the play of a non-billiards type game. More particularly, it is an object of the present invention to improve over the prior art by providing a shuffleboard accessory for use with a billiard table such that in combination with the existing features of the billiard table the shuffleboard accessory produces a recreational amusement adapted for the play of a table shuffleboard game.

Additionally, it is an object of the present invention to provide such a method and apparatus as also may include features for the protection of the billiard table in connection with which the shuffleboard accessory is utilized. Still further, it is an object of the present invention to provide such a method and apparatus that is reasonably compactly and therefor readily storable such that the shuffleboard accessory may be acquired and utilized notwithstanding that substantial space may already have been allocated to the placement of a billiard table. Finally, it is an object of the present invention to provide such a method and apparatus as also is economical to manufacture, thereby ensuring that the shuffleboard accessory is made as widely available as is possible.

SUMMARY OF THE INVENTION

In accordance with the foregoing objects, the present invention—a recreational amusement—generally comprises a shuffleboard accessory adapted for and utilized on and in connection with a billiard table to provide a table-type shuffleboard game. In implementing the recreational amusement of the present invention, at least one rail cushion of an otherwise conventional billiard table is utilized to form a rebounding cushion for use in play of the shuffleboard game. Various other elements, ranging from protective sheets to a rigid tray, may be included for protecting the relatively delicate materials forming the billiard table.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Figure 1:
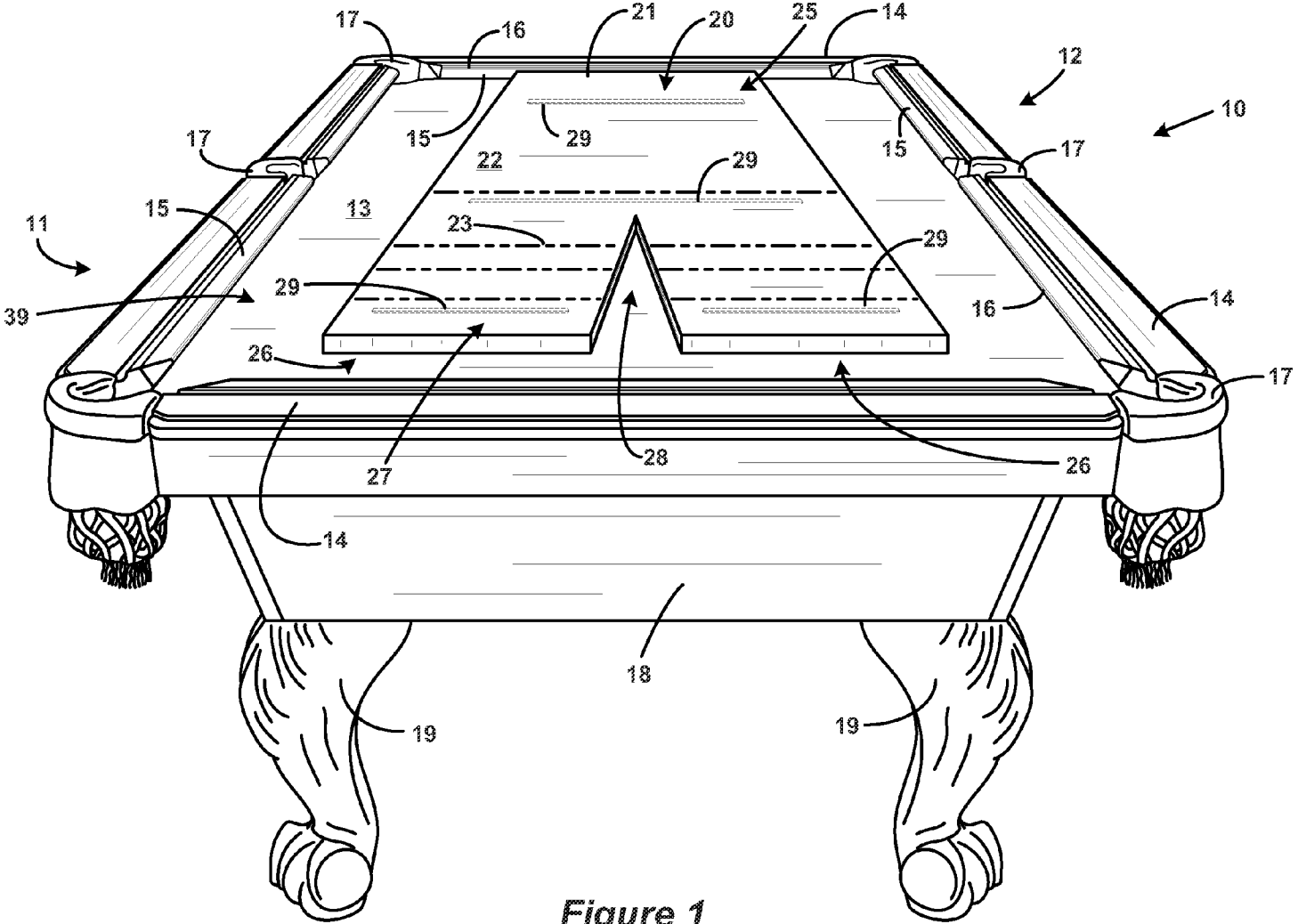
FIG. 1 shows, in a perspective view, a first embodiment of the recreational amusement of the present invention.

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the figures, the recreational amusement 10 of the present invention is shown to generally comprise a shuffleboard accessory 20 adapted for utilization in connection with a billiard table 11 and a billiard table 11, the integral combination providing a table-type shuffleboard game. As shown in the figures, and in FIGS. 1 and 3 in particular, the billiard table 11 conventionally comprises a table top 12 resting upon a base 18 supported upon a plurality of legs 19. As is conventional, the table top 12 of the billiard table 11 comprises a substantially flat bed 13, which is typically manufactured of a structurally stable material such as, for example, a slab of slate and is typically covered with a sheet of high quality worsted wool or the like. While the billiard table 11 as contemplated in the present invention may or may not comprise pockets 17 depending on the particular game for which the table 11 is primarily intended, the billiard table 11 will be characterized as comprising a plurality of rails 14 provided about and bounding the perimeter of the bed 11, the rails being interiorly provided with elastic cushions 15 conventionally manufactured from vulcanized rubber or a synthetic equivalent thereof, which cushions 15 typically comprise a nose 16 for the deflection of impacting balls during play of the billiards-type game. In any case, as is conventional, the provided cushions 15, including their nose sections 16, are like the bed 13 of the table 11 also covered with sheets of high quality worsted wool or the like.

Referring now to FIG. 1, a first embodiment of the recreational amusement 10 of the present invention is shown to comprise a shuffleboard accessory formed by providing a relatively thin slab 21 having a substantially planar top surface 22, the slab being sized such that when resting atop the bed 13 of a billiard table 11 the top surface 22 is positioned slightly beneath the nose 16 of the cushions 15. In this manner, as shown in the figures, the distal end 25 of the slab 21 forming the shuffleboard accessory 20 may be positioned adjacent a linear section of cushion 15 of the supporting table 11 such that the cushion 15 as primarily provided for the play of a billiards-type game forms a cushion for the play of a shuffleboard game. In particular, with the shuffleboard accessory 20 arranged as shown in FIG. 1, the resulting shuffleboard game is played by launching a puck (not shown, but well known to those of ordinary skill in the art) from the proximal end 26 of the slab 21. The launched puck then glides across the top surface 22 of the slab 21, striking the cushion 15 adjacent the distal end 25 and rebounding toward the scoring area 27 formed about the proximal end 26 of the top surface 22 of the slab 21. As will be appreciated by those of ordinary skill in the art, a player accumulates points based upon how close to the proximal end 26 the puck lands without sliding into one of the gutters 39, which gutters 39 are in the first embodiment cooperatively formed between the gutter edge of the slab 21 (which is, cumulatively, the edges about the top surface 22 of the slab 21 running from the first end of the distal edge 25 to the second end of the distal edge 25) and the rails 14 of the billiard table.

Figure 2:
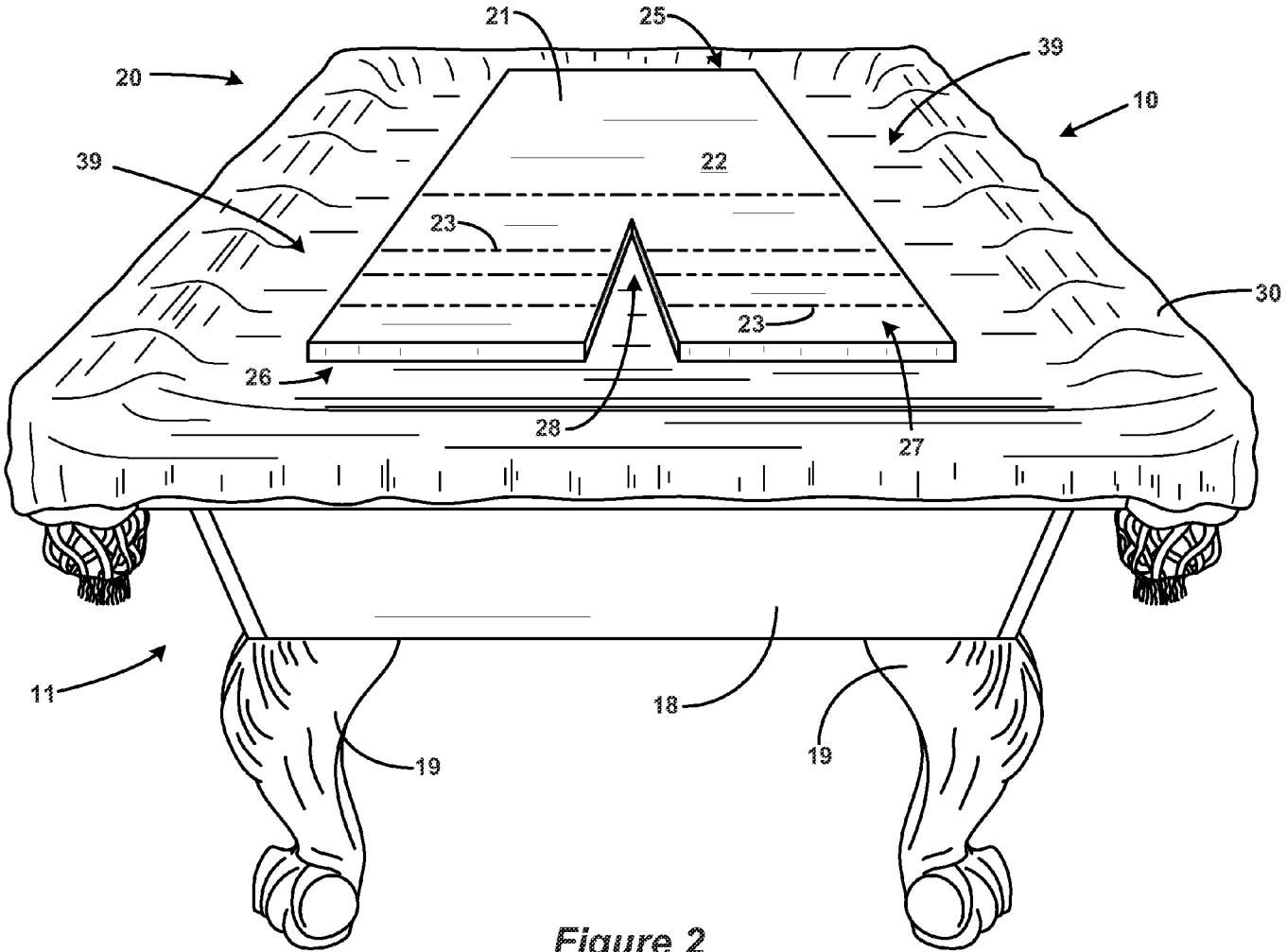
FIG. 2 shows, in a perspective view, a second embodiment of the recreational amusement of the present invention.
Figure 2A:
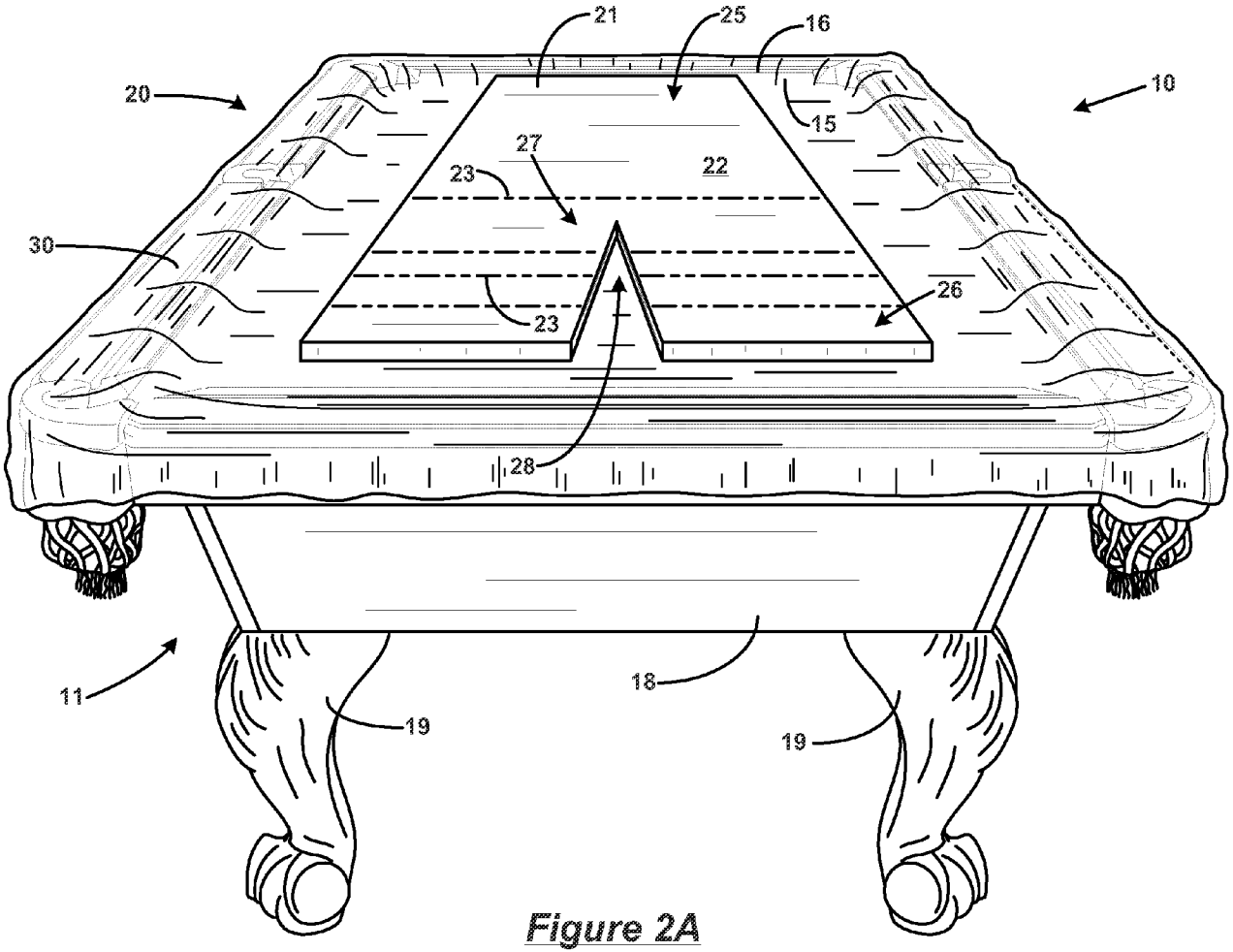
FIG. 2A shows, in the perspective view of FIG. 2, the recreational amusement of FIG. 2, FIG. 2A also, however, including representation of additional otherwise hidden detail.

As is otherwise conventional in the manufacture of table-type shuffleboard games, the slab 21 forming the shuffleboard accessory 20 is preferably constructed from a wood laminate, which laminate is generously coated with polyurethane or the like. In order to facilitate the free gliding of a puck over the top surface 22 of the slab 21, the slab 21 will generally be sprinkled liberally with tiny, sand-like beads of silicone, often referred to as shuffleboard wax, shuffleboard sand or shuffleboard cheese. Although this application is highly effective in decreasing friction between the top surface 21 of the shuffleboard accessory 20 and a puck gliding thereon, the application is potentially detrimental to the covering applied over the bed 13 of the billiard table 11. As a result, in a second embodiment of the present invention, as particularly shown in FIGS. 2 and 2A, the recreational amusement 10 further comprises a protective sheet 30 interposed the billiard table 11 and the shuffleboard accessory 20. The sheet 30, which preferably comprises vinyl, protects the coverings about the bed 13 and cushions 15 of the billiard table (as shown in FIG. 2) while nonetheless enabling sufficient impact between the gliding puck and the cushion 15 adjacent the distal end 25 of the shuffleboard accessory 20 (as shown in FIG. 2A) that uninhibited play of the shuffleboard game is maintained.

Figure 3:
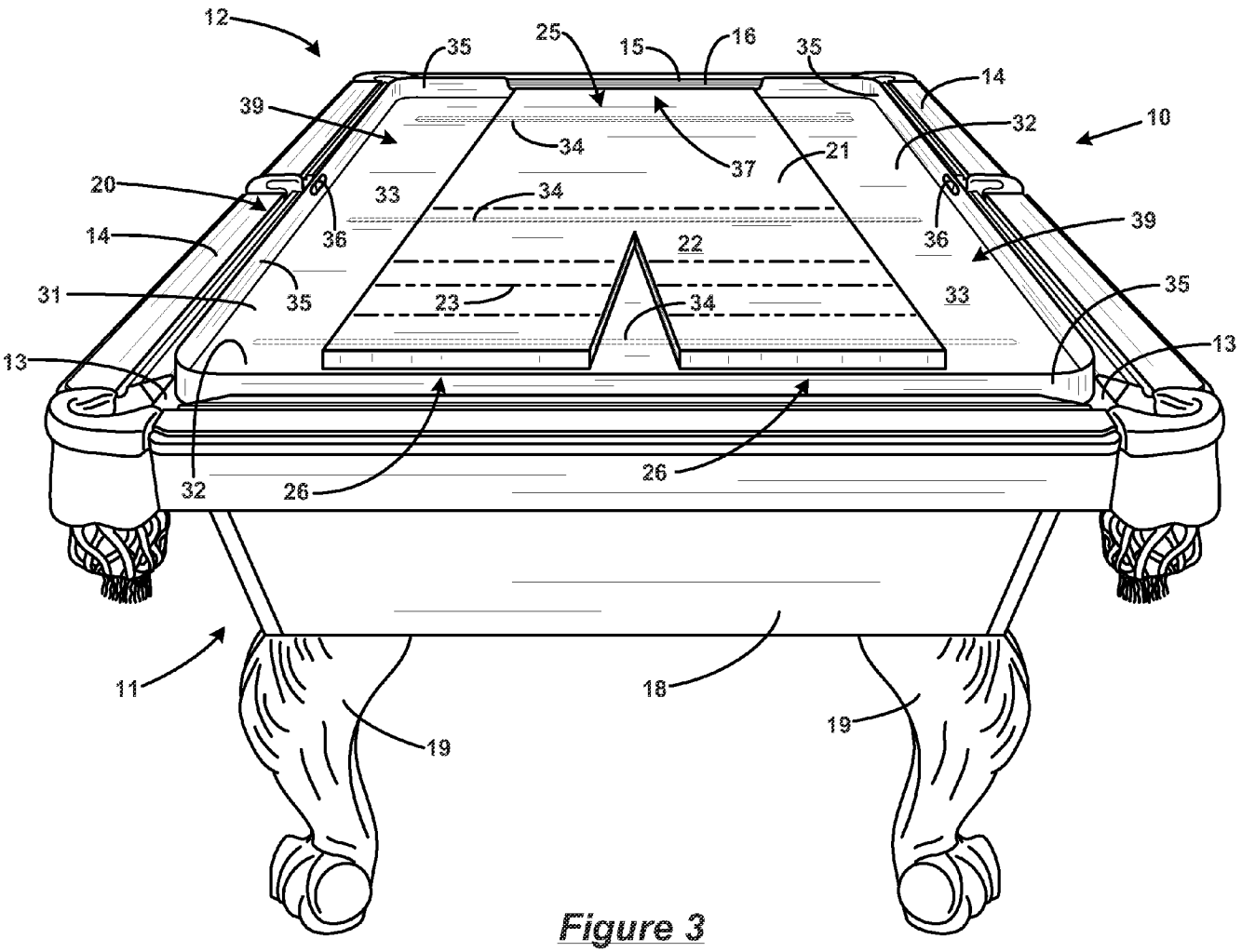
FIG. 3 shows, in a perspective view, a third embodiment of the recreational amusement of the present invention.
Figure 3A:
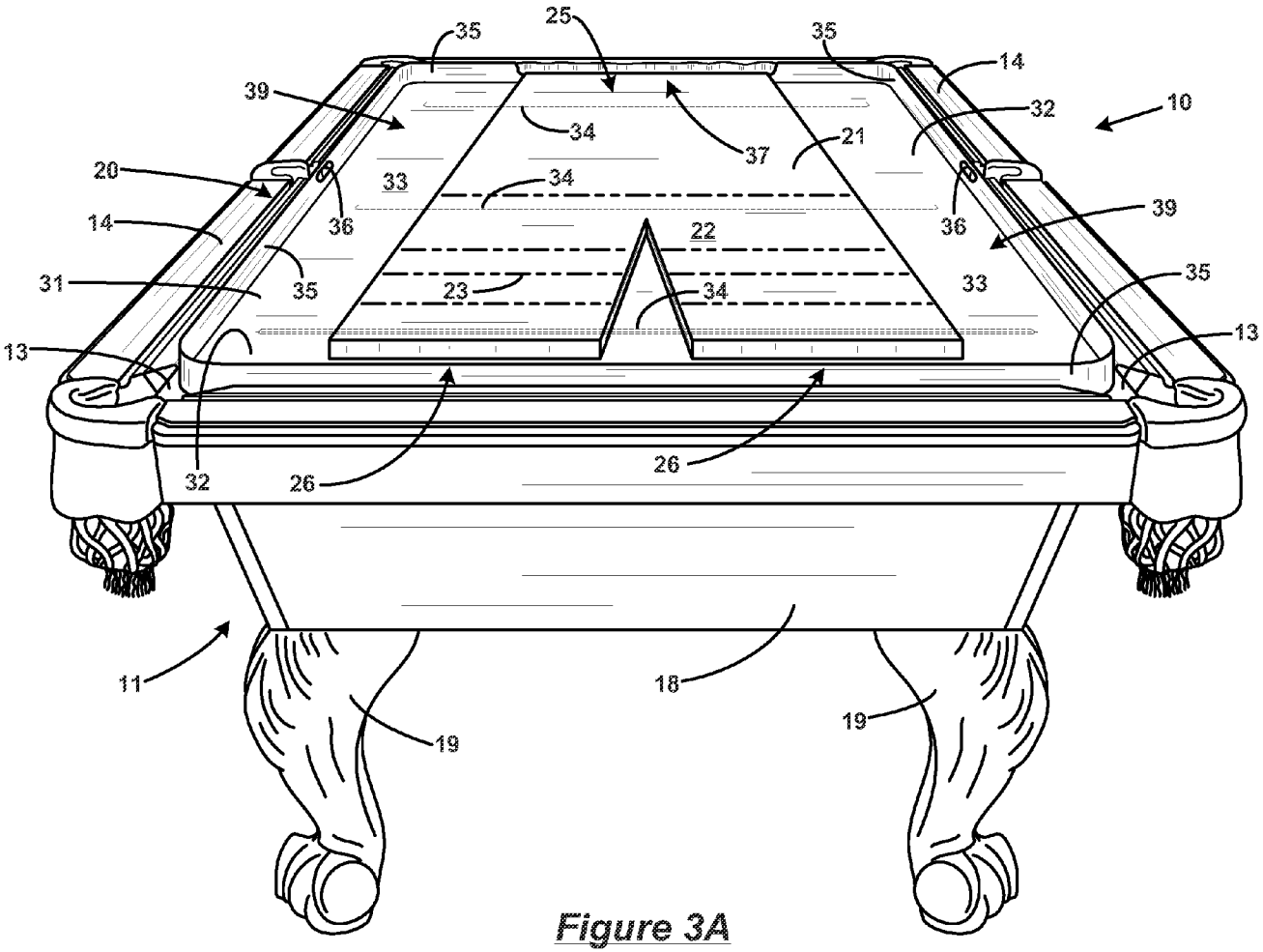
FIG. 3A shows, in the perspective view of FIG. 3, an extension of the invention of the recreational amusement of FIG. 3.

Referring now to FIG. 3, a third embodiment of the recreational amusement 10 of the present invention is shown to further comprise a tray 31 sized to fit within the extents of the cushions 15 of a billiard table 11. The otherwise previously described slab 21 is in this embodiment affixed to the top surface 33 of the base 32 of the tray 31, thereby forming gutters 39 about and between the slab 21 and the upwardly projecting sidewalls 35 of the tray, the resulting gutters 39 being completely segregated from the bed 13 of the billiard table 11. In order to enable utilization of the distal cushion 15 for play of the shuffleboard game, a notch 37 is provided in the distal sidewall 35 such that a gliding puck may impact the distal cushion 15 as previously described. Still further, as shown in FIG. 3A, a curtain 38 comprising, for example, a vinyl sheet, may also be provided about the notch 37 such that any applied silicone beads or the like are completely contained within the shuffleboard accessory 20 and maintained apart from the coverings for the bed 13 or cushions 15 of the billiard table 11. In any case, in order to facilitate the easy placement and removal of the shuffleboard accessory 20 as depicted in FIGS. 3 and 3A, a plurality of handles 36 are also provided in the sidewalls 35 of the tray.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, as particularly shown in FIG. 1, a plurality of pads 29 or other cushioning elements may be affixed to the bottom surface of the slab 21, which is especially desirable in the case of a slab 21 intended for direct contact with the relatively delicate covering of the bed 13 of a billiard table 11. Likewise, as particularly shown in FIGS. 3 and 3A, similar pads 34 or cushioning elements are preferably provided on the bottom surface of the tray 31.

Still further, those of ordinary skill in the art will recognize that scoring indicia 23 and/or ornamental features may as desired by applied to the top surface 22 of the slab 21 of the shuffleboard accessory 20. Likewise, a notch 28 may be formed in the slab 21 in order to increase difficulty of play, thereby enhancing the amusement afforded by the resulting invention. In any case, because the scope of the present invention is much broader than any particular embodiment, the foregoing detailed description should not be construed as a limitation of the scope of the present invention, which is limited only by the claims appended hereto.

What is claimed is:

1. A recreational amusement in the form of a table-type shuffleboard game, said recreational amusement comprising:
- a billiard table, said billiard table being characterized as a table having a top surface, said top surface comprising:
- a substantially flat bed; and
- wherein said flat bed is bounded by elastic cushions affixed to the inner sides of rails provided about the perimeter of said bed, said elastic cushions comprising a nose for the deflection of impacting balls during the play of billiards-type games;
- a shuffleboard accessory, said shuffleboard accessory comprising:
- a slab, said slab comprising:
- a substantially planar top surface;
- a substantially linear distal edge, said distal edge having a first end and a second end; and
- a gutter edge, said gutter edge running from the first end of said distal edge to the second end of said distal edge, whereby said gutter edge is cooperatively adapted with said distal edge to bound said top surface of said slab; and
- wherein:
- said slab has a thickness less than the height of said cushions above said flat bed; and
- said slab is sized to be contained within the extents of the inner sides of said rails provided about the perimeter of said flat bed such that a gutter about said shuffleboard accessory is formed between said gutter edge of said slab and said cushions when said distal edge of said slab is placed adjacent a linear section of said cushions; and
- said slab is removably rested atop said substantially flat bed of said billiard table with said substantially linear distal edge of said slab positioned beneath the nose of a portion of said elastic cushions such that said portion of said elastic cushions forms a deflector for rebounding of pucks during the play of a shuffleboard game.

2. The recreational amusement as recited in claim 1, wherein said slab comprises wood.

3. The recreational amusement as recited in claim 2, wherein said wood is coated with polyurethane.

4. The recreational amusement as recited in claim 2, wherein said slab comprises a laminate of wood.

5. The recreational amusement as recited in claim 4, wherein said laminate of wood is coated with polyurethane.

6. The recreational amusement as recited in claim 1, wherein said linear section of said cushions comprises a nose.

7. The recreational amusement as recited in claim 6, wherein said slab has a thickness less than the height above said bed of said nose of said linear section of said cushions.

8. The recreational amusement as recited in claim 1, wherein said shuffleboard accessory further comprises a means for protection of said billiard table.

9. The recreational amusement as recited in claim 8, wherein said means for protection comprises a protective sheet.

10. The recreational amusement as recited in claim 9, wherein said protection sheet comprises vinyl.

11. A recreational amusement in the form of a table-type shuffleboard game, said recreational amusement comprising:
- a billiard table, said billiard table being characterized as a table having a top surface, said top surface comprising:
  - a substantially flat bed; and
  - wherein said bed is bounded by elastic cushions affixed to the inner sides of rails provided about the perimeter of said bed;
- a shuffleboard accessory, said shuffleboard accessory comprising:
  - a slab, said slab comprising
    - a substantially planar top surface;
    - a substantially linear distal edge, said distal edge having a first end and a second end;
    - a gutter edge, said gutter edge running from the first end of said distal edge to the second end of said distal edge, whereby said gutter edge is cooperatively adapted with said distal edge to bound said top surface of said slab; and
    - a means for protection of said billiard table; and
- wherein:
  - said slab has a thickness less than the height above said bed of said cushions;
  - said slab is sized to be contained within the extents of the inner sides of said rails provided about the perimeter of said bed such that a gutter about said shuffleboard access is formed between said gutter edge of said slab and said cushions when said distal edge of said slab is placed adjacent a linear section of said cushions; and
  - said means for protection comprises a tray, said tray being sized to fit within the extents of said cushions.

12. The recreational amusement as recited in claim 11,wherein said slab is affixed to the top surface of the base of said tray.

13. The recreational amusement as recited in claim 12, wherein:
- said tray comprises a plurality of upwardly projecting sidewalk, one said sidewall being positioned adjacent said distal edge of said slab; and
- a notch is formed in said one sidewall adjacent said distal edge of said slab.

14. The recreational amusement as recited in claim 13, wherein said tray comprises a curtain about said notch in said one sidewall adjacent said distal edge of said slab.

15. The recreational amusement as recited in claim 14, wherein said curtain comprises vinyl.

16. The recreational amusement as recited in claim 15, wherein said sidewalls comprise a plurality of handles.

17. The recreational amusement as recited in claim 13, wherein said sidewalls comprise a plurality of handles.

18. The recreational amusement as recited in claim 1, wherein said gutter edge of said slab is shaped to form a notch is said top surface of said slab, said notch being provided as a means for increasing difficulty of the shuffleboard game.

* * * * *